US006349414B1

(12) United States Patent
Tillman

(10) Patent No.: US 6,349,414 B1
(45) Date of Patent: Feb. 26, 2002

(54) POWDER DISPENSING WRIST BAND DEVICE

(76) Inventor: Dorothea Tillman, 2358 Apple Rd., Fogelsville, PA (US) 18051-1907

( * ) Notice: Subject to any disclaimer, the term of this patent is extended or adjusted under 35 U.S.C. 154(b) by 0 days.

(21) Appl. No.: 09/728,758

(22) Filed: Dec. 4, 2000

(51) Int. Cl.[7] ..... A41D 20/00

(52) U.S. Cl. ..... 2/170; 401/8; 401/200

(58) Field of Search ..... 2/170, DIG. 11, 2/171.2, 16, 20, 158, 159, 161.1, 161.6, 162; 424/402, 404, 447, 65, 69; 401/6, 8, 195, 196, 200, 207; 604/292, 289, 293, 304, 308, 312; 206/205, 210

(56) References Cited

U.S. PATENT DOCUMENTS 2,643,389 A * 6/1953 Wegner ..... 2/170
3,473,699 A * 10/1969 Pike ..... 604/292
4,068,318 A * 1/1978 McMahon ..... 2/170
D259,220 S * 5/1981 Small et al. ..... D2/400
4,448,560 A * 5/1984 Monaco, Jr. ..... 401/200
4,462,116 A * 7/1984 Sanzone et al. ..... 2/170
4,502,156 A * 3/1985 Wishman ..... 2/181
4,572,690 A * 2/1986 Savanuck ..... 401/200
5,146,630 A * 9/1992 Richard ..... 2/24
5,214,798 A * 6/1993 McLaughlin ..... 2/160
5,305,470 A * 4/1994 McKay ..... 2/7
5,318,371 A * 6/1994 Niewulis ..... 401/6
5,329,638 A * 7/1994 Hansen et al. ..... 2/16
5,671,481 A * 9/1997 Giard ..... 2/170
5,678,510 A * 10/1997 Sharpless ..... 119/605
6,171,006 B1 * 1/2001 Woodall ..... 401/200

* cited by examiner

*Primary Examiner*—Amy B. Vanatta
(74) *Attorney, Agent, or Firm*—LaMorte & Associates

(57) ABSTRACT

A powder dispensing device for dispensing moisture absorbing powder to a person during the play of a sport or other physical activity is claimed. The device includes a wrist band that is worn around the wrist. The wrist band supports a pocket, wherein the pocket defines a confined area. Contained within the confined area of the pocket is a volume of powder. The powder can be contained in a bag or can be directly poured into the pocket. As least a portion of the structure of the pocket is porous to the powder. As such, when the pocket on the wrist band is contacted, a small amount of powder is dispensed.

9 Claims, 4 Drawing Sheets

POWDER DISPENSING WRIST BAND DEVICE

BACKGROUND OF THE INVENTION

1. Field of the Invention

In general, the present invention relates to rosin bags and like structures that are use to dispense small amounts of moisture absorbing powder into the hands. More particularly, the present invention relates to rosin bags and like structures that are formed into secondary products.

2. Description of the Prior Art

Rosin bag is the name typically given to a small cloth bag filled with a moisture absorbing powder. The powder can be rosin, talcum powder, baby powder or the like. As the rosin bag is lifted and manipulated in the hands, a small amount of powder from within the bag migrates through the weave of the bag's fabric and is dispensed into the hands. The powder dispensed into the hands absorbs moisture on the hands, thereby keeping the hands dry.

Rosin bags are used in many different sports. For example, rosin bags are often used by bowlers so that their fingers stay dry and do not slip out of the bowling ball. Rosin bags are also used in sports that use rackets or clubs, such as tennis and golf, so that moisture on the hands does not interfere with a proper firm grip.

In the past, the rosin bag was manufactured as a separate small bag that was kept out of the way until needed. As such, a tennis player would have to walk to the sidelines to retrieve and use a rosin bag. Similarly, a golfer would have to walk over to his/her golf bag to retrieve and use the rosin bag. However, when a person is in a game, they do not always have the opportunity to stop play so that they can retrieve and use their rosin bag. As such, many players forego the use of the rosin bag until a convenient time arises. This often causes players to play with moist hands. This may, in turn, lead to players having poor grips during play.

A need therefore exists for a rosin bag configuration that would enable the rosin bag to always be convenient for a player to use at any time during the play of a game. This need is met by the present invention as described and claimed below.

SUMMARY OF THE INVENTION

The present invention is a powder dispensing device for dispensing moisture absorbing powder into a person's hand during the play of a sport or other physical activity. The device includes a wrist band that is worn around the wrist. The wrist band supports a pocket, wherein the pocket defines a confined area. Contained within the confined area of the pocket is a volume of powder. The powder can be contained in a bag or can be directly filled into the pocket. As least a portion of the structure of the pocket is porous. As such, when the pocket on the wrist band is contacted by a person's hand, a small amount of powder is dispensed.

The powder dispensing device is worn on the wrist. The structure of the wrist band absorbs moisture that flows toward the hand from the arm. The periodic dispensing of powder into the hand helps keep the hand dry. The powder dispensing device can also be touched to other parts of the body, such as the brow, to absorb moisture on those surfaces. As such, the device helps keep a different areas of a person's body dry while playing a sport or conducting another physical activity.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
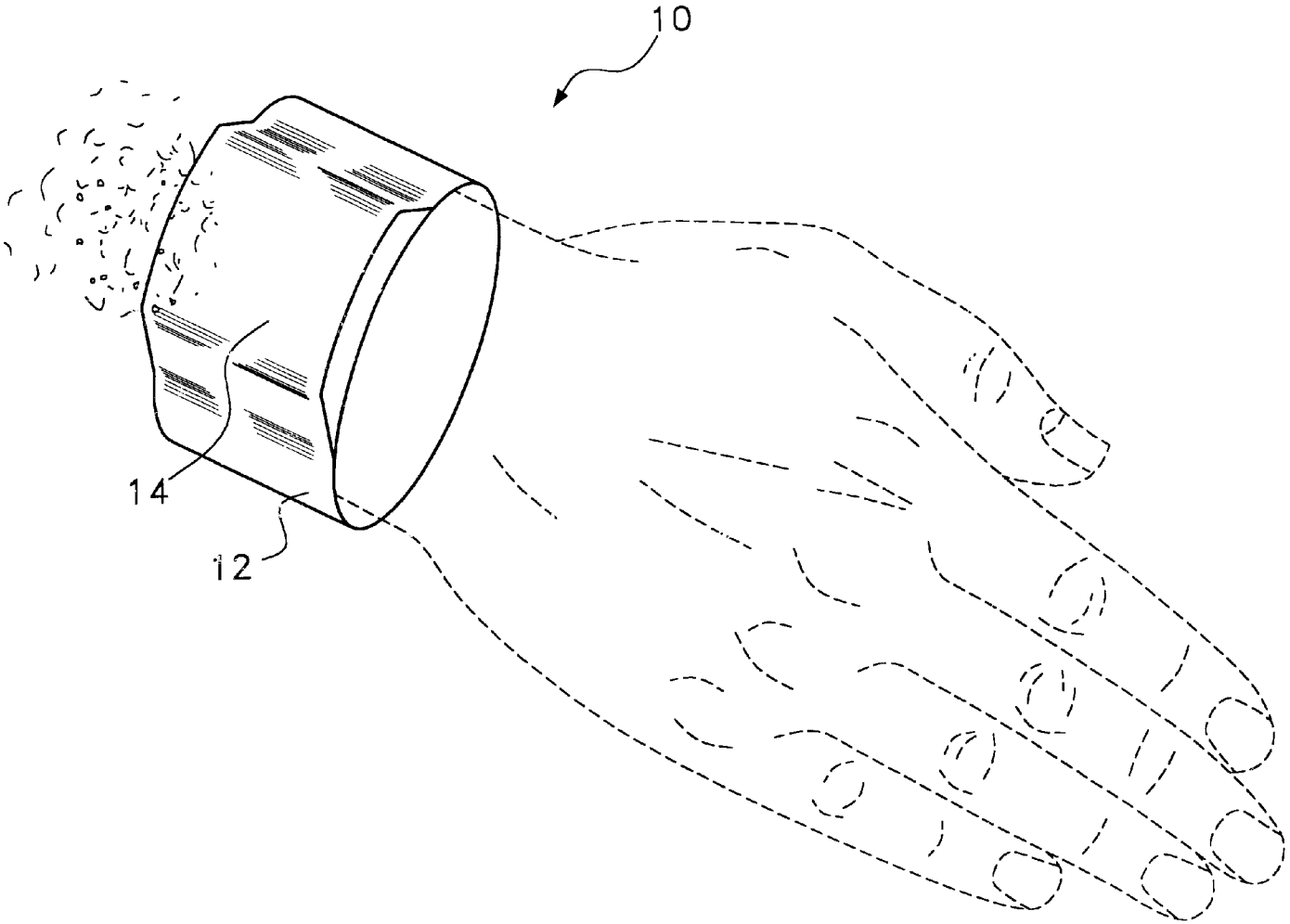
FIG. 1 is a perspective view of one preferred embodiment of a powder dispensing device in accordance with the present invention.
Figure 2:
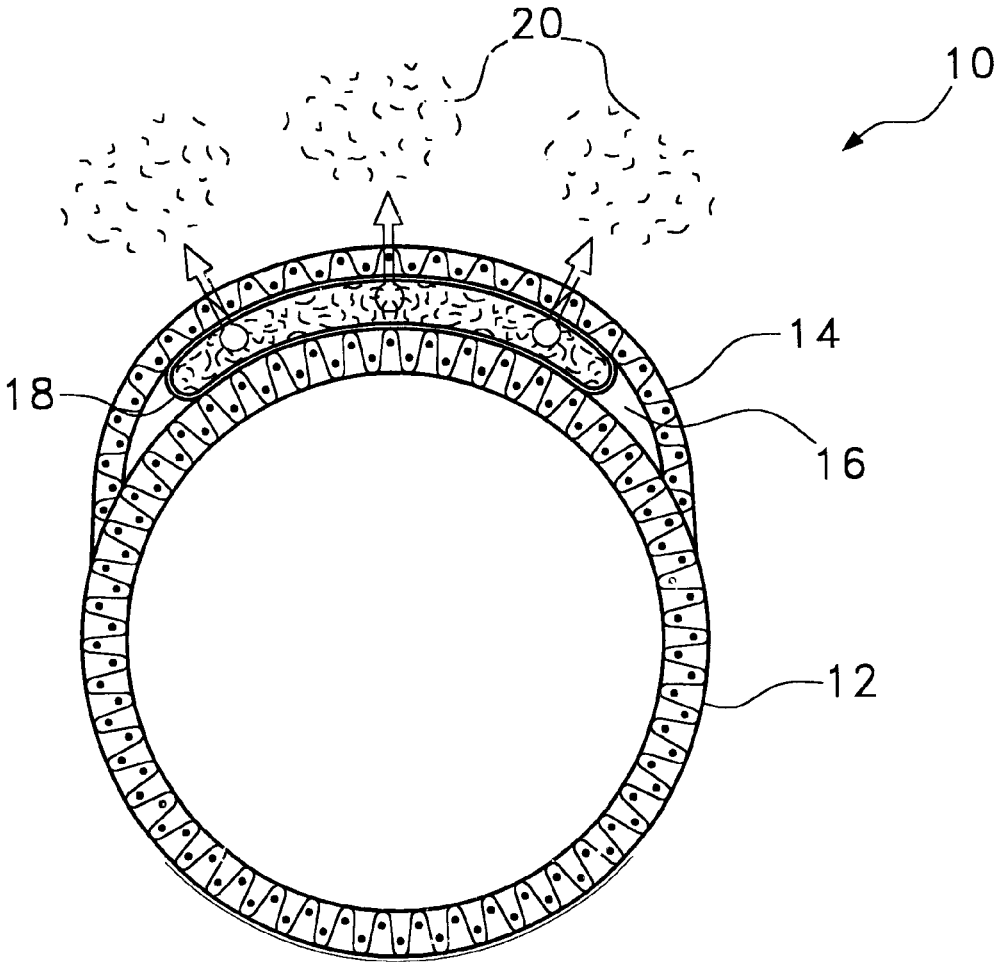
FIG. 2 is a cross-sectional view of the embodiment shown in FIG. 1.

Referring to FIG. 1, in conjunction with FIG. 2, a first embodiment of the present invention powder dispensing device 10 is shown. The powder dispensing device 10 combines the structure of a rosin bag with the structure of a wrist worn sweat band. The powder dispensing device 10 includes a knit wrist band 12. The wrist band 12 is knit from moisture absorbing yarns and elastic threads. The moisture absorbing yarns absorb sweat and other moisture that it contacts. The preferred moisture absorbing yarn is cotton, however, other natural and synthetic materials can be used. The elastic threads contained in the wrist band 12 provide the wrist band 12 with elastic properties. This enables the wrist band 12 to be biased against the wrist when worn around the wrist. The powder dispensing device 10 will therefore remain firmly attached around the wrist of a person while that person is playing a sport.

A material segment 14 extends over one side of the wrist band 12. The material segment 14 defines an open area 16 (FIG. 2) between the material segment 14 and the wrist band 12. The material segment 14 is made from a knit material, wherein the knit pattern of the material is highly porous. The material used in the formation of the material segment 14 can be the same as the material used in the formation of the wrist band 12. However, the elastic threads used in the wrist band 12 need not be present within the material segment 14.

In the embodiment of FIG. 1 and FIG. 2, the open area 16 defined between the material segment 14 and the wrist band 12 is entirely isolated. As such, there is no means of non-destructively accessing the open area 16 after the powder dispensing device 10 is manufactured.

Referring now solely to FIG. 2, it can be seen that a rosin bag 18 is placed within the open area 16 under the material segment 14 during the manufacture of the powder dispensing device 10. The term rosin bag is used in the generic sense to describe any porous bag that contains a volume of moisture absorbing powder 20. The powder 20 may be rosin, talcum, baby powder, corn starch or any other functional equivalent.

As the powder dispensing device 10 is manipulated, powder 20 migrates through the rosin bag 18 and fills the open area 16 in which the rosin bag 18 is placed. The powder 20 then migrates through the material of the material segment 14. As such, every time the exterior surface of the material segment 14 is contacted, a small volume of powder 20 is dispensed.

To use the powder dispensing device 10, the wrist band portion 12 of the device 10 is placed around the wrist, prior to playing a game. As a person sweats, the wrist band section 12 of the device absorbs any perspiration that may flow down toward the hand from the arm. As the hand itself becomes moist with perspiration, a person simply periodically touches his/her hand to the exterior of the material segment 14. As a person touches the exterior of the material segment 14, a small amount of powder 20 will be dispensed. The powder absorbs the perspiration in the hand and keeps the hand dry during the game.

Accordingly, a person can dispense moisture absorbing powder 20 into their hands at any time during a game, by simply tapping the powder dispensing device 10 held on the wrist. The powder dispensing device 10 will continue to dispense powder 20 until the powder 20 contained within the internal rosin bag 18 is exhausted. As that time, the powder dispensing device 10 is replaced with another. It will therefore be understood that the volume of powder 20 in the device 10 and the dispensing rate of the materials can be varied to effect the planned obsolescence of the device 10.

Figure 3:
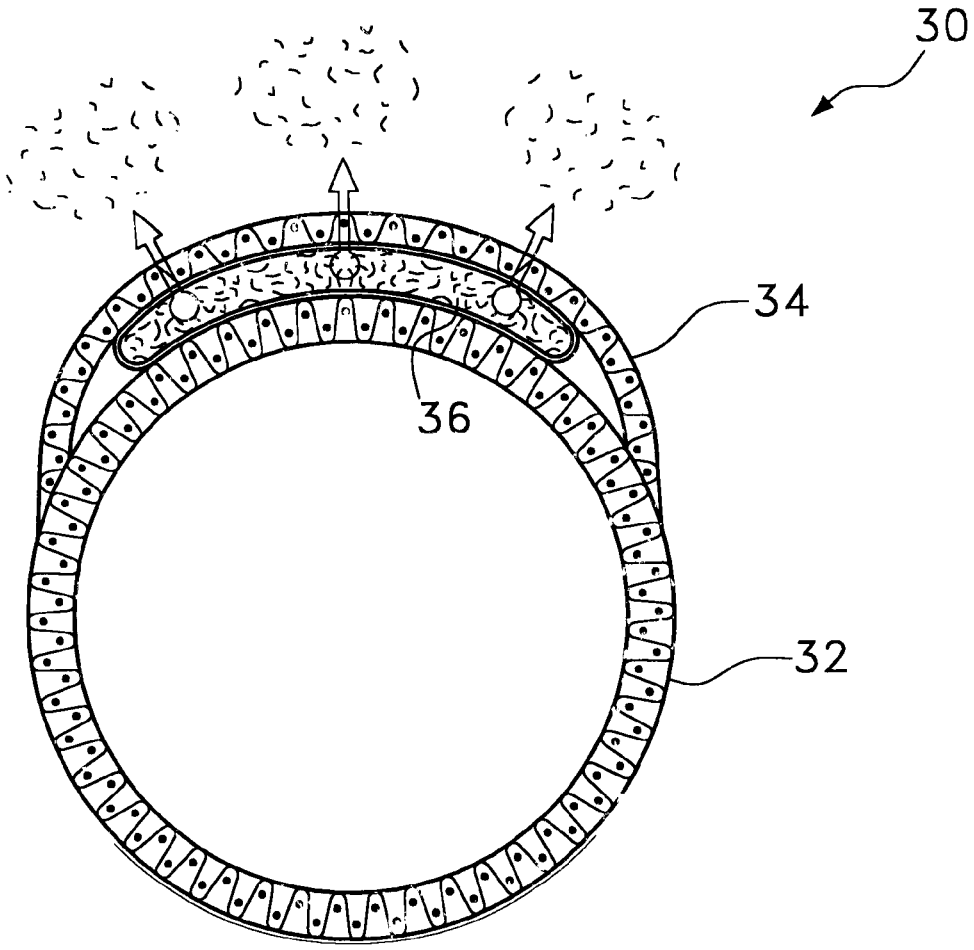
FIG. 3 is a cross-sectional view of an alternate embodiment of a powder dispensing device in accordance with the present invention.

Referring now to FIG. 3, an alternate embodiment of the present invention powder dispensing device 30 is shown. In this embodiment, a separate rosin bag is not used. Rather, the open space between the material segment 34 and the wrist band 32 is directly filled with a powder 36. In such an embodiment, the density of the knit pattern of the material segment 34 controls the dispensing rate of the powder 36 rather than the separate rosin bag.

Figure 4:
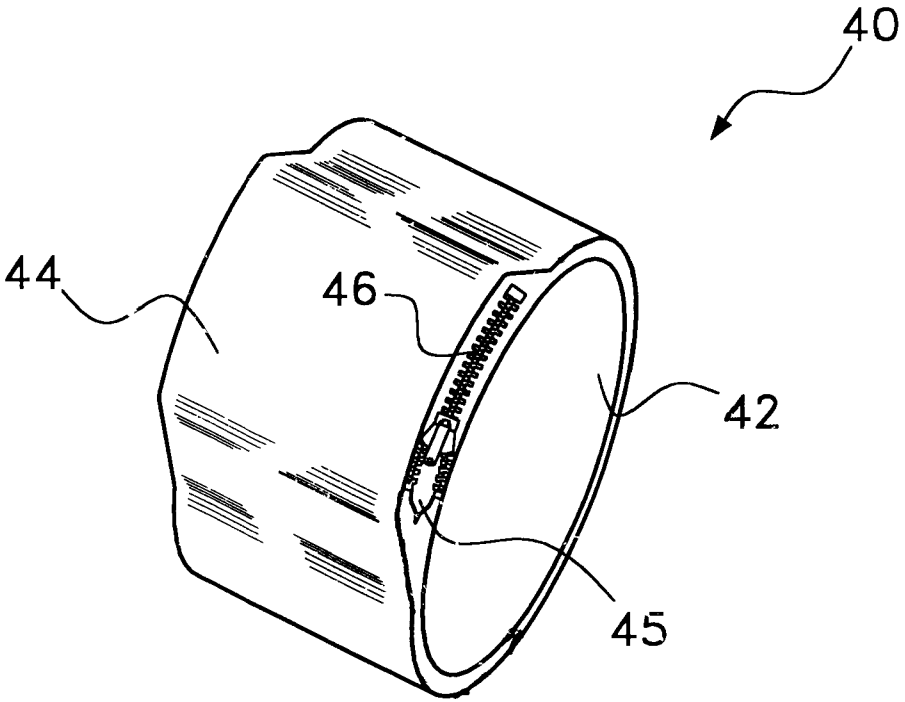
FIG. 4 is a perspective view of another alternate embodiment of a powder dispensing device in accordance with the present invention.

Referring to FIG. 4, another alternate embodiment of the present invention powder dispensing device 40 is shown. In this embodiment, the open area 45 between the material segment 44 and the wrist band 42 is accessible by an access opening 46. In the shown embodiment, the access opening 46 is shown having a zipper closure. Such a closure mechanism is merely exemplary and other closures, such as Velcro, overlapping flaps and the like can be used.

The existence of the access opening 46 enables the contents of the open area 45 under the material segment 44 to be either removed or replenished. For example, suppose a separate rosin bag is being used in the open area 45 behind the access opening 46 and the rosin bag is running low on powder. Using the access opening 46, the rosin bag can be replaced. Similarly, by using the access opening 46, the rosin bag can be temporarily removed so that the remainder of the powder dispensing device 40 can be laundered.

If powder is directly retained in the open area 45 between the material segment 44 and the wrist band 42, the presence of the access opening 46 provides a means for refilling the dispensing device 40 should the initial powder supply run low. The existence of the access opening 46 also allows a person to change the type of powder being dispensed depending upon the situation. For example, a person may want to use one type of powder when bowling and another type of powder when he/she plays golf. By providing the access opening, such a change in powder types can be easily made.

It will be understood that the embodiments of the present invention described and illustrated herein are merely exemplary and a person skilled in the art can make many variations to the embodiments shown without departing from the scope of the present invention. All such variations, modifications and alternate embodiments are intended to be included within the scope of the present invention as defined by the appended claims.

What is claimed is:

1. A device, comprising:

a wrist band having an annular structure, wherein said wrist band is made of water absorbent material;

a pocket disposed within said wrist band, wherein said pocket defines a confined area that extends across no more than half of said annular structure;

an access opening for selectively opening and closing said pocket;

a bag sized to fit within said confined area of said pocket;

a volume of powder disposed within said bag, wherein both said bag and said pocket are porous to said powder.

2. The device according to claim 1, wherein said wrist band contains elastic.

3. The device according to claim 1, wherein said bag is selectively removable from said pocket through said access opening.

4. The device according to claim 1, wherein said powder is selected from a group consisting of rosin, talcum, baby powder, cornstarch and combinations thereof.

5. A powder dispensing device for a person's wrist, comprising:

a sealed bag;

a volume of powder having moisture absorbing properties disposed within said bag;

a cloth pocket that defines an open internal space, wherein said bag is disposed in said cloth pocket and said cloth pocket is porous to the powder;

a band structure coupled to said cloth pocket for enabling said cloth pocket to be positioned on top of a person's wrist, wherein said band structure passes around the bottom of the wrist.

6. The device according to claim 5, wherein said powder is selected from a group consisting of rosin, talcum, baby powder, cornstarch and combinations thereof.

7. The device according to claim 5 wherein said band structure is a knit band having water absorbing properties.

8. The device according to claim 7, wherein said band structure contains elastic for retaining said band structure on a person's wrist.

9. The device according to claim 5, wherein said pocket includes a selectively closable access opening.

* * * * *